US009635941B2

(12) United States Patent
Bates et al.

(10) Patent No.: US 9,635,941 B2
(45) **Date of Patent: *May 2, 2017**

(54) WALL MOUNTED ASSEMBLY

(71) Applicant: Herman Miller, Inc., Zeeland, MI (US)

(72) Inventors: Mark Bates, Westwood, MA (US); Andrew J. Boyce, Hopkinton, MA (US); Chul Min Kang, Coral Springs, FL (US); Michael J. Katje, Grand Haven, MI (US); Susan R. Lyons, New York, NY (US); Kurt E. Porter, Holland, MI (US); Jeffrey D. Roetman, West Olive, MI (US); Perry L. Sellers, Hudsonville, MI (US); Gianfranco Dino Zaccai, Needham, MA (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/790,410

(22) Filed: Jul. 2, 2015

(65) Prior Publication Data

US 2015/0296983 A1 Oct. 22, 2015

Related U.S. Application Data

(63) Continuation of application No. 14/174,491, filed on Feb. 6, 2014, now Pat. No. 9,072,381, which is a (Continued)

(51) Int. Cl.
*E04B 2/74* (2006.01)
*E04H 1/00* (2006.01)
(Continued)

(52) U.S. Cl.
CPC ..... *A47B 96/06* (2013.01); *A47B 95/008* (2013.01); *A47B 96/067* (2013.01);
(Continued)

(58) Field of Classification Search
CPC ... A47B 95/008; A47B 96/067; A47B 97/001; A47B 96/06; E03C 1/181; E03C 1/00
(Continued)

(56) References Cited

U.S. PATENT DOCUMENTS 544,105 A 8/1859 Madsen
243,374 A 6/1881 Howard et al.
(Continued)

FOREIGN PATENT DOCUMENTS

CA 1204968 A 5/1986
CA 2228531 A 7/2002
(Continued)

OTHER PUBLICATIONS

Cascade, Modular Linen Trolleys, www.cascadeuk.com, 1 page.
(Continued)

*Primary Examiner* — Chi Q Nguyen
(74) *Attorney, Agent, or Firm* — Michael Best & Friedrich LLP

(57) ABSTRACT

A wall assembly includes at least one horizontally extending rail having a rear surface adapted to engage the wall. A plurality of horizontally spaced and vertically extending stiles are coupled to the rail, with the stiles disposed forwardly of the rear surface of the rail. A plurality of interface components are coupled to the plurality of stiles. In various embodiments, the stiles may be interconnected to draw together adjacent interface components. The interface components also may include overlapping upper and lower edges. The stiles may be vertically and/or horizontally (laterally and longitudinally) adjustable relative to the rail. A lock member may be provided to secure at least one of the stiles to the rail. Various systems and methods of assembly and use are also provided.

49 Claims, 8 Drawing Sheets

Related U.S. Application Data continuation of application No. 13/718,287, filed on Dec. 18, 2012, now Pat. No. 8,667,742, which is a continuation of application No. 13/023,007, filed on Feb. 8, 2011, now Pat. No. 8,333,038.

(60) Provisional application No. 61/303,510, filed on Feb. 11, 2010.

(51) Int. Cl.

| | |
|---|---|
| ***A47F 10/00*** | (2006.01) |
| ***A47B 96/06*** | (2006.01) |
| ***A47B 95/00*** | (2006.01) |
| ***A47B 97/00*** | (2006.01) |
| ***E03C 1/181*** | (2006.01) |
| ***E03C 1/00*** | (2006.01) |

(52) U.S. Cl.
CPC ..... *A47B 97/001* (2013.01); *E03C 1/00* (2013.01); *E03C 1/181* (2013.01)

(58) Field of Classification Search
USPC ..... 52/36.6, 36.5, 36.1, 238.1
See application file for complete search history.

(56) References Cited

U.S. PATENT DOCUMENTS

| | | | | |
|---|---|---|---|---|
| 327,094 | A | | 9/1885 | Lowrie |
| 342,538 | A | | 5/1886 | Reid |
| 595,544 | A | | 12/1897 | Love |
| 942,014 | A | | 11/1909 | Schneider et al. |
| 1,082,250 | A | | 12/1912 | Watrous |
| 1,209,555 | A | | 12/1916 | Carlson |
| 1,745,002 | A | | 1/1930 | Brotz |
| 1,831,966 | A | | 11/1931 | Mason |
| 1,843,635 | A | | 2/1932 | Taylor |
| 1,974,794 | A | | 9/1934 | Blickman |
| 2,157,251 | A | | 5/1939 | Tinnerman |
| D116,497 | S | | 9/1939 | Lingard |
| 2,456,065 | A | | 8/1945 | Just |
| D182,716 | S | | 5/1958 | Ferguson |
| RE24,627 | E | | 4/1959 | Jacobs |
| 2,896,896 | A | | 7/1959 | Revzin |
| 2,992,743 | A | | 7/1961 | Wing |
| D192,958 | S | | 6/1962 | Benson |
| 3,116,947 | A | | 1/1964 | Brownrigg |
| D200,962 | S | | 4/1965 | McCarthy |
| D206,079 | S | | 10/1966 | Swett |
| 3,299,444 | A | | 1/1967 | Gangelhoff |
| 3,412,422 | A | | 11/1968 | Champlin |
| 3,424,344 | A | | 1/1969 | Robinson |
| 3,432,944 | A | | 3/1969 | Ishida |
| 3,447,193 | A | | 6/1969 | Bush |
| 3,447,194 | A | | 6/1969 | Bush |
| 3,456,865 | A | | 7/1969 | Frank |
| 3,576,277 | A | | 4/1971 | Blackmon |
| 3,623,633 | A | | 11/1971 | Kinn |
| 3,660,591 | A | | 5/1972 | Schultz et al. |
| 3,752,550 | A | | 8/1973 | Niemeyer |
| 3,769,502 | A | | 10/1973 | Schultz et al. |
| 3,870,591 | A | | 3/1975 | Witman |
| 3,903,671 | A | | 9/1975 | Cuin et al. |
| 3,908,059 | A | | 9/1975 | Prince |
| 3,931,429 | A | | 1/1976 | Austin |
| 3,978,258 | A | | 8/1976 | Faust et al. |
| 3,987,599 | A | | 10/1976 | Hines |
| 3,992,730 | A | | 11/1976 | Davis |
| 4,002,386 | A | | 1/1977 | McKenzie |
| D248,923 | S | | 8/1978 | Spellier |
| 4,172,169 | A | | 10/1979 | Mawson et al. |
| D257,426 | S | | 10/1980 | D'Alo |
| 4,239,170 | A | | 12/1980 | Planebo |
| 4,254,569 | A | | 3/1981 | Janik |
| 4,338,485 | A | | 7/1982 | Fullenkamp et al. |
| 4,348,447 | A | | 9/1982 | Miller, Jr. et al. |
| 4,418,109 | A | | 11/1983 | Miller, Jr. et al. |
| 4,498,693 | A | | 2/1985 | Schindele |
| 4,524,483 | A | | 6/1985 | Lynham et al. |
| 4,586,762 | A | | 5/1986 | Kennedy et al. |
| 4,602,756 | A | | 7/1986 | Chatfield |
| 4,622,257 | A | | 11/1986 | Thompson |
| 4,624,020 | A | | 11/1986 | Abderhalden et al. |
| 4,627,546 | A | | 12/1986 | Carranza |
| 4,646,211 | A | | 2/1987 | Gallant et al. |
| 4,684,099 | A | | 8/1987 | Krapf |
| 4,685,255 | A | | 8/1987 | Kelley |
| 4,689,259 | A | | 8/1987 | Miller, Jr. et al. |
| 4,709,517 | A | | 12/1987 | Mitchell et al. |
| 4,725,030 | A | | 2/1988 | Miller et al. |
| 4,784,446 | A | | 11/1988 | Newhouse |
| 4,807,659 | A | | 2/1989 | Schindele |
| 4,869,378 | A | | 9/1989 | Miller |
| 4,905,433 | A | | 3/1990 | Miller |
| 4,969,220 | A | | 11/1990 | Raigneau |
| 5,007,211 | A | * | 4/1991 | Ouellet ..... B65G 69/008 52/173.2 |
| 5,038,539 | A | | 8/1991 | Kelley et al. |
| D320,683 | S | | 10/1991 | Welch |
| 5,059,471 | A | | 10/1991 | McNally et al. |
| 5,060,425 | A | | 10/1991 | Kappers et al. |
| D324,284 | S | | 2/1992 | Welch |
| 5,159,793 | A | | 11/1992 | Deugo et al. |
| 5,185,904 | A | | 2/1993 | Rogers et al. |
| 5,197,511 | A | | 3/1993 | Kohn et al. |
| 5,230,109 | A | | 7/1993 | Zaccai et al. |
| 5,257,423 | A | | 11/1993 | Jacobsen et al. |
| 5,261,127 | A | | 11/1993 | Tsipov |
| 5,299,395 | A | * | 4/1994 | Smith ..... E04F 10/005 52/73 |
| 5,301,477 | A | | 4/1994 | Rellinger et al. |
| 5,323,565 | A | | 6/1994 | Kappers et al. |
| 5,328,730 | A | | 7/1994 | Lowe |
| 5,380,549 | A | | 1/1995 | Harvison |
| 5,383,240 | A | | 1/1995 | Weeks, Sr. |
| 5,412,816 | A | | 5/1995 | Paterson et al. |
| 5,428,928 | A | | 7/1995 | Hellwig et al. |
| 5,452,484 | A | | 9/1995 | Hill |
| 5,467,915 | A | | 11/1995 | Mattson |
| 5,472,167 | A | | 12/1995 | Shillington et al. |
| 5,546,720 | A | | 8/1996 | Labruzza |
| 5,553,892 | A | | 9/1996 | Pitchford et al. |
| 5,566,404 | A | | 10/1996 | Laughton |
| 5,566,961 | A | | 10/1996 | Snell et al. |
| 5,571,588 | A | | 11/1996 | Lussi et al. |
| 5,586,352 | A | | 12/1996 | O'Brien et al. |
| 5,622,016 | A | * | 4/1997 | Frommelt ..... B65G 69/008 52/11 |
| 5,653,064 | A | | 8/1997 | Kappers et al. |
| 5,658,635 | A | | 8/1997 | Davis et al. |
| 5,682,695 | A | | 11/1997 | Hoffman |
| 5,727,579 | A | | 3/1998 | Chardack |
| 5,732,724 | A | | 3/1998 | Becknell |
| 5,735,593 | A | | 4/1998 | Gallant et al. |
| 5,756,993 | A | | 5/1998 | Yoshinari et al. |
| 5,799,428 | A | | 9/1998 | Poindexter |
| 5,802,640 | A | | 9/1998 | Ferrand et al. |
| 5,829,723 | A | | 11/1998 | Brunner et al. |
| D402,528 | S | | 12/1998 | Brucker |
| 5,866,225 | A | | 2/1999 | Crossley |
| 5,953,871 | A | | 9/1999 | MacConnell et al. |
| 5,961,194 | A | | 10/1999 | Shaw |
| 5,966,760 | A | | 10/1999 | Gallant et al. |
| 5,992,430 | A | | 11/1999 | Chardack et al. |
| 6,014,850 | A | | 1/2000 | LeMire |
| 6,016,578 | A | | 1/2000 | Malouf |
| 6,019,481 | A | | 2/2000 | Ambach et al. |
| 6,110,292 | A | | 8/2000 | Jewett et al. |
| D433,012 | S | | 10/2000 | Arsenault |
| 6,145,253 | A | | 11/2000 | Gallant et al. |
| 6,161,347 | A | | 12/2000 | Yu et al. |
| 6,167,664 | B1 | | 1/2001 | Reuter et al. |
| 6,206,206 | B1 | | 3/2001 | Saylor et al. |
| D440,020 | S | | 4/2001 | Ronson et al. |

(56) References Cited

U.S. PATENT DOCUMENTS 6,243,993 B1 6/2001 Swensson
6,253,395 B1 7/2001 Quam
6,253,513 B1 7/2001 Saida
6,256,936 B1 7/2001 Swensson et al.
6,263,602 B1 7/2001 Seiber et al.
6,267,338 B1 7/2001 Saylor et al.
6,272,779 B1 8/2001 Seiber et al.
6,279,179 B1 8/2001 Register
6,279,761 B1 8/2001 Niewiadomski et al.
6,295,764 B1 10/2001 Berridge et al.
6,302,366 B1 10/2001 Saylor et al.
6,325,097 B1 12/2001 Gallant et al.
6,328,571 B1 12/2001 Dricken et al.
6,360,389 B1 3/2002 Gallant et al.
6,393,782 B1 5/2002 Berridge et al.
D458,800 S 6/2002 Kotsonis
6,405,491 B1 6/2002 Gallant
6,407,335 B1 6/2002 Franklin-Lees et al.
6,413,618 B1 7/2002 Parker et al.
D462,871 S 9/2002 Kramer et al.
6,550,875 B1 4/2003 Compton et al.
6,564,398 B1 5/2003 Trott
6,593,528 B2 7/2003 Franklin-Lees et al.
D479,947 S 9/2003 Claypool
6,622,980 B2 9/2003 Boucher et al.
6,647,652 B1 11/2003 Seiber et al.
6,665,908 B1 12/2003 Mease
6,668,493 B1 12/2003 Walker
6,681,529 B1 1/2004 Baloga et al.
6,688,056 B2 2/2004 Von Hoyningen Huene et al.
6,701,682 B2 * 3/2004 Ando ..... G06Q 10/10 52/234
6,725,483 B2 4/2004 Gallant et al.
D489,263 S 5/2004 Sinanian
6,739,096 B2 5/2004 Feldpausch et al.
6,748,710 B2 6/2004 Gresham et al.
6,782,593 B1 8/2004 Shimony
6,807,776 B2 * 10/2004 Girdwood ..... A47B 83/001 160/130
6,848,589 B2 2/2005 Wood
6,854,202 B1 2/2005 Ives et al.
6,895,704 B2 5/2005 Ives et al.
6,895,715 B2 5/2005 Gallant et al.
6,920,727 B2 7/2005 Yu et al.
6,951,087 B2 10/2005 Weurman
6,964,138 B2 11/2005 Carroll et al.
6,971,197 B1 12/2005 Seiber et al.
6,978,499 B2 12/2005 Gallant et al.
6,981,937 B2 1/2006 Dufrene
7,007,347 B2 3/2006 Roels
7,040,057 B2 5/2006 Gallant et al.
7,040,726 B2 5/2006 Steffee
7,055,287 B2 6/2006 Yu et al.
7,065,812 B2 6/2006 Newkirk et al.
7,089,708 B1 8/2006 Bostock
D530,053 S 10/2006 Bothun et al.
D531,779 S 11/2006 Huguet
7,147,196 B2 12/2006 Knight et al.
7,150,127 B2 * 12/2006 Underwood ..... A47B 46/005 108/106
7,174,678 B2 2/2007 Gallant
7,185,469 B2 3/2007 Schaffeld
7,204,714 B2 4/2007 Walker et al.
7,211,726 B2 5/2007 Bally et a
7,219,472 B2 5/2007 Gallant et al.
D544,105 S 6/2007 Flechsig
7,227,081 B2 6/2007 Bally et al.
7,243,386 B2 7/2007 Gallant et al.
7,296,808 B2 11/2007 Huguet
7,325,343 B2 2/2008 Seiber et al.
7,392,621 B2 7/2008 Gallant et al.
7,425,679 B2 9/2008 Kasten et al.
D583,664 S 12/2008 Franzone, Jr.
D588,678 S 3/2009 Chong et al.
D588,685 S 3/2009 Chong
7,540,040 B2 6/2009 Roenick
7,549,893 B1 6/2009 Walker et al.
7,565,760 B2 7/2009 Maier-Hunke
D600,334 S 9/2009 Chong
7,604,481 B2 10/2009 Owen et al.
7,874,842 B2 1/2011 Beno
8,042,308 B2 10/2011 Sullivan et al.
8,136,680 B2 3/2012 Sugarman
8,333,038 B2 * 12/2012 Bates ..... A47B 95/008 52/238.1
8,474,193 B2 7/2013 Sutton et al.
8,474,921 B2 7/2013 Newkirk et al.
8,667,742 B2 * 3/2014 Bates ..... A47B 95/008 52/238.1
8,689,493 B2 * 4/2014 Alarcon ..... A47F 5/00 312/234
8,713,857 B2 * 5/2014 Logue ..... A47B 46/005 160/200
9,010,033 B2 * 4/2015 Woods ..... A47B 5/00 52/239
9,072,381 B2 * 7/2015 Bates ..... A47B 95/008
2002/0108330 A1 * 8/2002 Yu ..... E04B 2/7433 52/238.1
2002/0112411 A1 * 8/2002 Gravel ..... E04B 2/7422 52/36.1
2003/0177713 A1 9/2003 Walker et al.
2004/0035079 A1 2/2004 Evjen
2004/0231248 A1 11/2004 Walker et al.
2004/0237202 A1 * 12/2004 Gallant ..... A61G 7/00 5/658
2005/0145769 A1 7/2005 Ives et al.
2005/0236347 A1 10/2005 Cole et al.
2005/0246832 A1 11/2005 Zoller et al.
2005/0253034 A1 11/2005 Bally et al.
2007/0069093 A1 3/2007 Graham et al.
2007/0119117 A1 5/2007 Gibbs
2007/0199263 A1 8/2007 Kern et al.
2007/0261353 A1 11/2007 Cullen
2007/0267209 A1 11/2007 Bally et al.
2007/0267219 A1 11/2007 Schindele et al.
2007/0283630 A1 12/2007 Kasdorf et al.
2008/0036342 A1 2/2008 Heyer
2008/0276567 A1 11/2008 Rapaz
2009/0211019 A1 8/2009 Schluttig
2009/0293391 A1 * 12/2009 DeVore ..... A47B 83/001 52/239
2010/0176266 A1 7/2010 Minkley et al.
2011/0283632 A1 * 11/2011 Sutton ..... A47B 46/005 52/36.1
2012/0049018 A1 3/2012 Sugarman
2012/0317894 A1 12/2012 Von Hoyningen Huene et al.
2013/0111827 A1 5/2013 Hartwell et al.
2013/0180202 A1 * 7/2013 Woods ..... A47B 5/00 52/710

FOREIGN PATENT DOCUMENTS

CH 685799 A 10/1995
CN 202102609 A 1/2012
DE 4022313 A1 1/1992
DE 9408189 A1 12/1994
DE 20114182 A1 1/2003
EP 588573 A1 3/1994
EP 1293149 A1 3/2003
FR 2829004 A 3/2003
GB 2130181 A 5/1984
GB 2319002 A 5/1998
JP 61118284 A 6/1986
JP 06321669 A 11/1994
JP 2006241971 A 9/2006
WO 86/03539 6/1986

OTHER PUBLICATIONS

Signature Hardware, "Farmer Sink with Offset Drain," Product Nos. 195331 and 195332, 1 page.

(56) References Cited

OTHER PUBLICATIONS

GCX, Instrument Mounting Systems, Wall Channels—Standard, Mounting Channels, 5 pages.
Glove Saver, Respiratory—Hygiene-Station—Dispenser—Large, Item No. MD-100, 2 pages.
Hill-Rom, Horizon/UniFlex Accessories, various products, © 2006, 20 pages.
Hill-Rom, Integris® B Series Headwall System, Equipment Rail & Prima Xtend Accessories various products, © 2006, 35 pages.
Hill-Rom, Power Column, Flatwall Headwall System and Contour Headwall System, various products, © 2007, 6 pages.
Lifespan Healthcare, Product Catalog: Fails and Accessories, © 2004, 2 pages.
Lifespan Healthcare, System Components & General Purpose Accessories, lifespanhealthcare.com, 12 pages.
Midmark International, Midmark 662 Towel Glove & Cup Dispenser, © 1999-2009, 1 page.
Modular Services Company, Accessories, "Create to Organize and Support," www.headwalls.com, 26 pages.
Modular Services Company, Home Products, Products—Provider Plus. www.headwalls.com, 2 pages.
Steelcase, Inc., Nurture, Opus, Casegoods, © 2007, 8 pages.
Steelcase, Inc., Planning Ideas, Opus: Patient Room 1, © 1996-2009, 1 page.

* cited by examiner

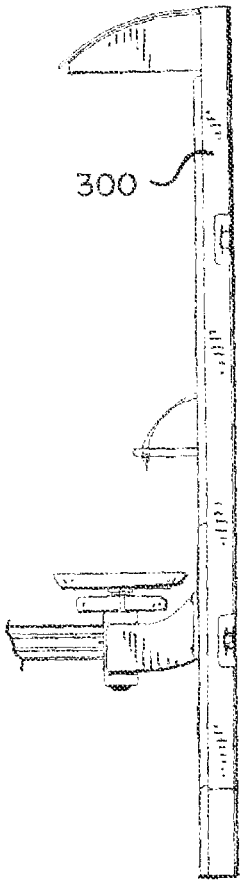
FIG. 12
FIG. 12A
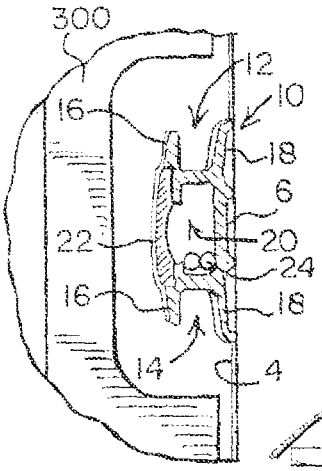
FIG. 13
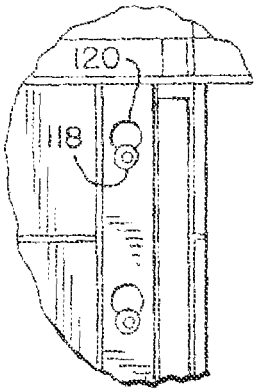
FIG. 15
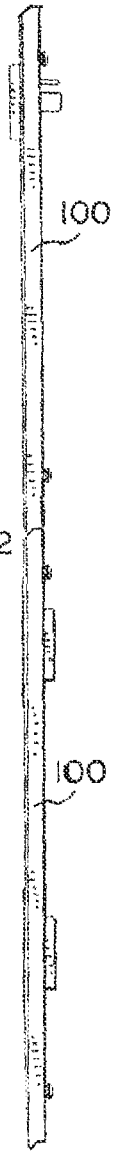
FIG. 14
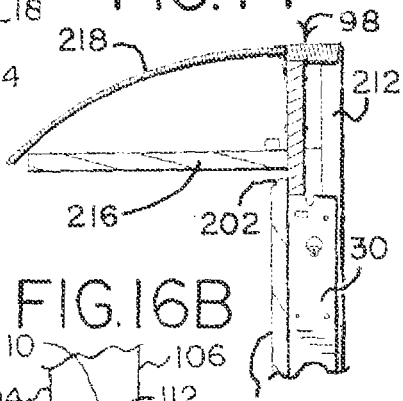
FIG. 16A
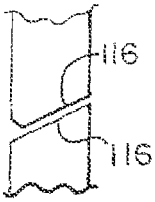
FIG. 16B
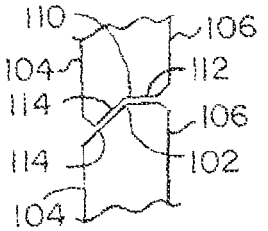
FIG. 16
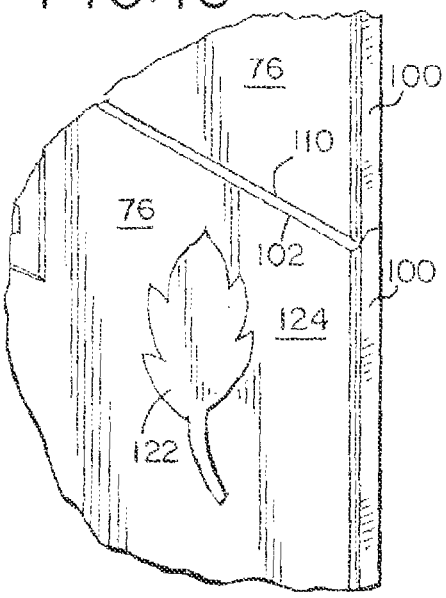
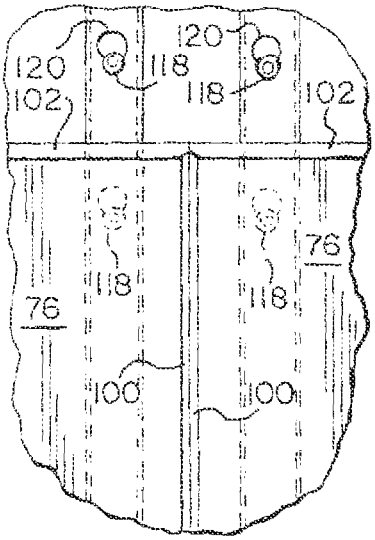
FIG. 17

WALL MOUNTED ASSEMBLY

CROSS REFERENCE TO RELATED APPLICATIONS

This application is a continuation of U.S. patent application Ser. No. 14/174,491, filed Feb. 6, 2014, now U.S. Pat. No. 9,072,381, which is a continuation of U.S. patent application Ser. No. 13718287, filed Dec. 18, 2012, now U.S. Pat. No. 8,667,742, which is a continuation of U.S. patent application Ser. No. 13/023,007, filed Feb. 8, 2011, now U.S. Pat. No. 8,333,038, which application claims the benefit of U.S. Provisional Application Ser. No. 61/303,510, filed Feb. 11, 2010, the entire disclosures of which are hereby incorporated herein by reference.

FIELD OF THE INVENTION

The present invention relates generally to a wall assembly, and in particular to a wall mounted assembly, including for example a modular wall assembly for use in a healthcare environment.

BACKGROUND

Rooms are often configured with various user interface components, such as storage cabinets, shelving, worksurfaces and the like. In some settings, such as a healthcare environment, there also may be a need to provide an interface for various utilities, including water, gas, electrical and data outlets. Typically, rooms in such environments are configured with structural or architectural walls. In such environments, it may be desirable to mount the interface components to the structural walls so as to maximize the floor space for movement of various devices such as beds, transport systems, portable monitoring devices and the like, while also minimizing the risk of such components falling or being inadvertently moved or damaged.

Some systems provide for one or more rails to be mounted to the structural walls, as shown for example in PCT Publication WO 86/03539, assigned to MTD-Produkter I Smaland AB. Various modules and equipment may then be secured to the rails. The rails, or components supported thereon, however, form various gaps or provide exposed surfaces, horizontal and vertical, in which fluids, dirt and other contaminants can accumulate. The irregular surfaces and gaps may make cleaning and sanitization difficult. In addition, such "open" systems, with exposed infrastructure, may not be aesthetically pleasing, and do not provide opportunities for routing or storing various utilities.

In addition, such systems typically lack any capability to adjust the vertical position of the components on the rails, or the lateral "in-out" position of the components relative to the wall. While this may not be a problem when dealing with spaced apart individual components mounted to the rails, it may create an uneven appearance, present gaps and other areas for contaminant accumulation, and make the installation difficult when the components are positioned adjacent each other.

SUMMARY

The present invention is defined by the following claims, and nothing in this section should be considered to be a limitation on those claims.

In one aspect, one embodiment of a wall assembly includes at least one horizontally extending rail having a rear surface adapted to engage the wall. A plurality of horizontally spaced and vertically extending stiles are coupled to the rail, with the stiles disposed forwardly of the rear surface of the rail. A plurality of interface components are coupled to the plurality of stiles.

In one embodiment, the plurality of interface components includes at least first, second and third interface components. The first interface component is disposed above and adjacent to the second interface component, and the third interface component is disposed adjacent at least the first interface component in a side-by-side relationship. A lower edge of the first interface component overlaps an upper edge of the second interface component. The lower edge has a forwardly and downwardly extending bottom surface mating with a forwardly and downwardly extending upper surface of the upper edge. A connector member extends between and is coupled to at least a pair of horizontally spaced stiles. The connector member is operable between an unclamped configuration and a clamped configuration. The connector draws adjacent side edges of the first and third interface component together when in the clamped configuration.

In another aspect, one embodiment of a wall assembly includes a horizontally extending rail and a vertically extending stile. A connector engages the rail and is adjustably coupled to the stile. The connector is moveable between at least first and second connector positions, wherein the stile is moved vertically relative to the rail between first and second stile positions corresponding to the first and second connector positions. An interface component is coupled to the stile.

In another aspect, one embodiment of a wall assembly includes a horizontally extending rail having a rear surface adapted to engage a wall. A vertically extending stile is coupled to the rail. A lateral adjustment device is adjustably coupled to the stile. The lateral adjustment device is vertically spaced from the rail and includes a wall engaging surface. The lateral adjustment device is horizontally moveable relative to the stile from at least a disengaged position to an engaged position, wherein the wall engaging surface is positioned to be spaced from the wall when the lateral adjustment device is in the disengaged position, and wherein the wall engaging surface is positioned to engage the wall when the lateral adjustment device is in the engaged position. An interface component is coupled to the stile.

In yet another aspect, one embodiment of a wall assembly at least one horizontally extending rail having a rear surface adapted to engage a wall and a plurality of horizontally spaced and vertically extending stiles coupled to the rail. A plurality of interface components are positioned side-by-side, wherein each of the interface components is coupled to at least a pair of the plurality of stiles. At least one connector member extends between and is coupled to pairs of stiles coupled respectively to adjacent interface components, wherein the plurality of stiles and the plurality of interface components are interconnected. A lock member is configured to be moved from a locked position, wherein the lock member is coupled between one of the stiles and the rail such that the plurality of interconnected stiles and interface components are horizontally fixed relative to the rail, and an unlocked position, wherein the plurality of interconnected stiles and interface components are horizontally moveable relative to and along the rail.

In another aspect, one embodiment of a wall assembly includes a horizontally extending rail having a rear surface adapted to engage the wall. A vertically extending stile is coupled to the rail. A canopy is coupled to the stile and is cantilevered laterally outwardly from the stile. An interface component is coupled to the stile below the canopy.

In yet another aspect, one embodiment of a wall assembly includes upper and lower horizontally extending and vertically spaced rails each having a rear surface adapted to engage a wall. A plurality of horizontally spaced and vertically extending stiles are coupled to the upper and lower rails. Each of the stiles includes a front surface. Moreover, the plurality of stiles includes a pair of horizontally spaced outermost stiles defining a space therebetween. A plurality of interface components are coupled to the plurality of stiles. The interface components mate with each other such that an entirety of the interior space and the front surfaces of the plurality of stiles are covered by the plurality of interface components.

In the various aspects, the wall assemblies are mounted to one or more walls. Various utilities, including water, gas, electrical power and data lines may be routed to and connected to various outlets in the interface components. Various methods of use and assembly are also provided.

The various aspects and wall assembly embodiments, and methods for the use thereof, provide significant advantages over other wall assemblies. For example and without limitation, the system can be modular, with the interface components being quickly and easily reconfigured to provide different modules depending on desired configuration and/or environment of use. At the same time, the junctions between adjacent interface components, and the overall façade of the system, are virtually seamless, with any vertical or horizontal gaps penetrating to a backside of the interface components being essentially eliminated. In this way, the system is particularly well suited for healthcare environments. In particular, the monolithic and unitary façade prevents fluids and other contaminants, including bacteria, from penetrating the façade and becoming trapped in or between the stiles, rails and/or wall. Moreover, in the event of a spill or other contamination, the components can be easily cleaned without concern for penetration.

The system also provides for the position of each stile to be individually adjusted relative to the rail, both vertically and horizontally (laterally and longitudinally). In this way, the stiles can be appropriately positioned such that the interface components are properly positioned and aligned. In addition, the lateral adjustment device provides for the stiles to be preloaded against the wall, such that they are not loose. In addition, since the interface components making up any one module are interconnected, the entire module can be horizontally locked by way of securing a single stile, for example with a locking member. Likewise, one or more stiles can be configured with anti-dislodgment devices to prevent the system from being dislodged from the rail or rails.

It should be understood that while the presently disclosed system is particularly well suited for healthcare environments, it may also be used in various home, workplace, office and educational environments.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

BRIEF DESCRIPTION OF THE DRAWINGS

FIG. 12 is a side view of one embodiment of a wall assembly.

FIG. 12A is an enlarged cross-sectional view of one embodiment of a rail.

FIG. 13 is a partial view of a tile to stile interface.

FIG. 14 is a cross-sectional side view of a canopy applied to a stile.

FIG. 15 is a side view of upper and lower tiles in a mated, overlapping configuration.

FIG. 16 is an enlarged view of the overlapping edges of an upper tile and a lower tile.

FIG. 16A is an alternative embodiment of an overlapping edge configuration of upper and lower tiles.

FIG. 16B is an enlarged side view of the overlapping edges of the tiles shown in FIG. 16.

FIG. 17 is a partial front view of a pair of side-by-side tiles.

DETAILED DESCRIPTION OF THE PRESENTLY PREFERRED EMBODIMENTS

General Description:

It should be understood that the term "plurality," as used herein, means two or more. The term "coupled" means connected to or engaged with whether directly or indirectly, for example with an intervening member, and does not require the engagement to be fixed or permanent, although it may be fixed or permanent. The term "first," "second," and so on, as used herein are not meant to be assigned to a particular component so designated, but rather are simply referring to such components in the numerical order as addressed, meaning that a component designated as "first," may later be a "second" such component, depending on the order in which it is referred. It should also be understood that designation of "first" and "second" does not necessarily mean that the two components or values so designated are different, meaning for example a first component may be the same as a second component, with each simply being applicable to different components of the same size and configuration.

As used herein, the terms "rear" or "rearwardly" refer to a location towards a wall, while the terms "front," "forward" or "forwardly" refer to a location away from the wall. Thus, the phrase "extending forwardly" refers to something going away from the wall, while the phrase "extending reawardly" refers to something going toward the wall. The term "lateral" refers to a sideways direction, for example perpendicular to the wall. The term "longitudinal" refers to a lengthwise direction, for example along a length of a rail. It should be understood that the term "healthcare facility" or "healthcare environment" refers to any environment wherein a patient, whether human or animal, is capable of being treated or otherwise attended to, including hospitals (human and animal), clinics (temporary and permanent), schools, doctor's offices, nursing homes, ambulances, and the like. The term "interface component" refers to any component, such as tile, cabinet, shelving, storage, work-surface, washstation, equipment rail, or other furniture device that forms an outer façade of the system and interfaces with the user.

Figure 1:
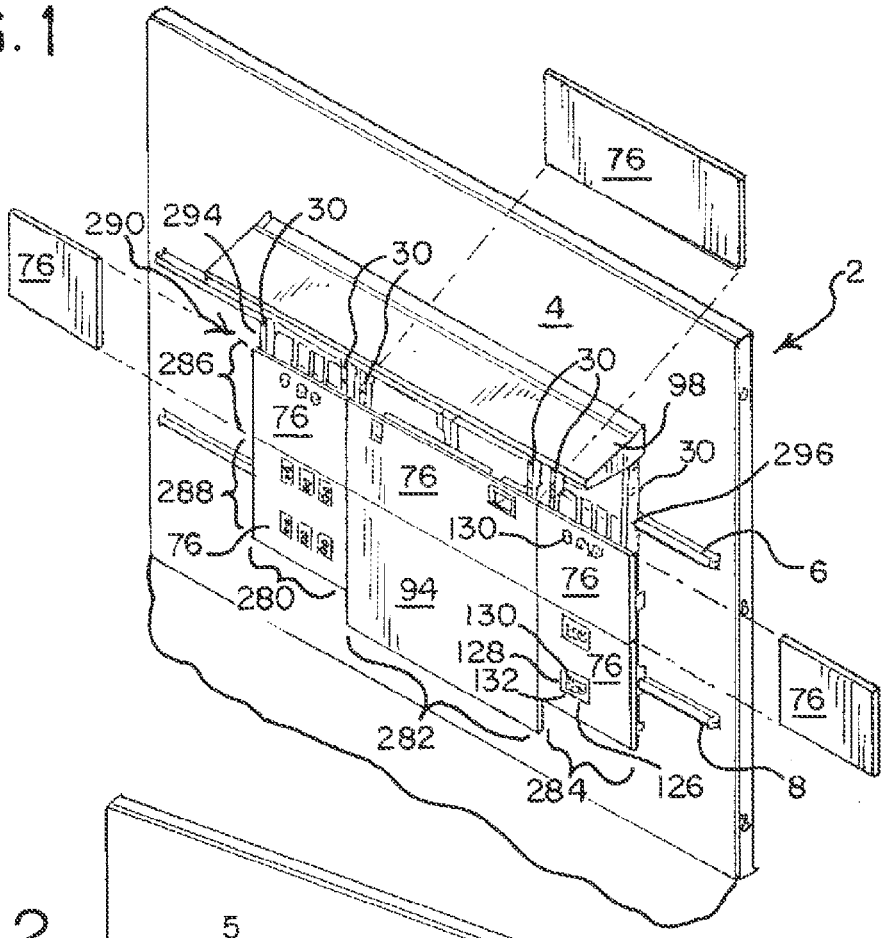
FIG. 1 is a perspective view of one embodiment of wall assembly for a healthcare facility with a row of upper tiles removed.
Figure 2:
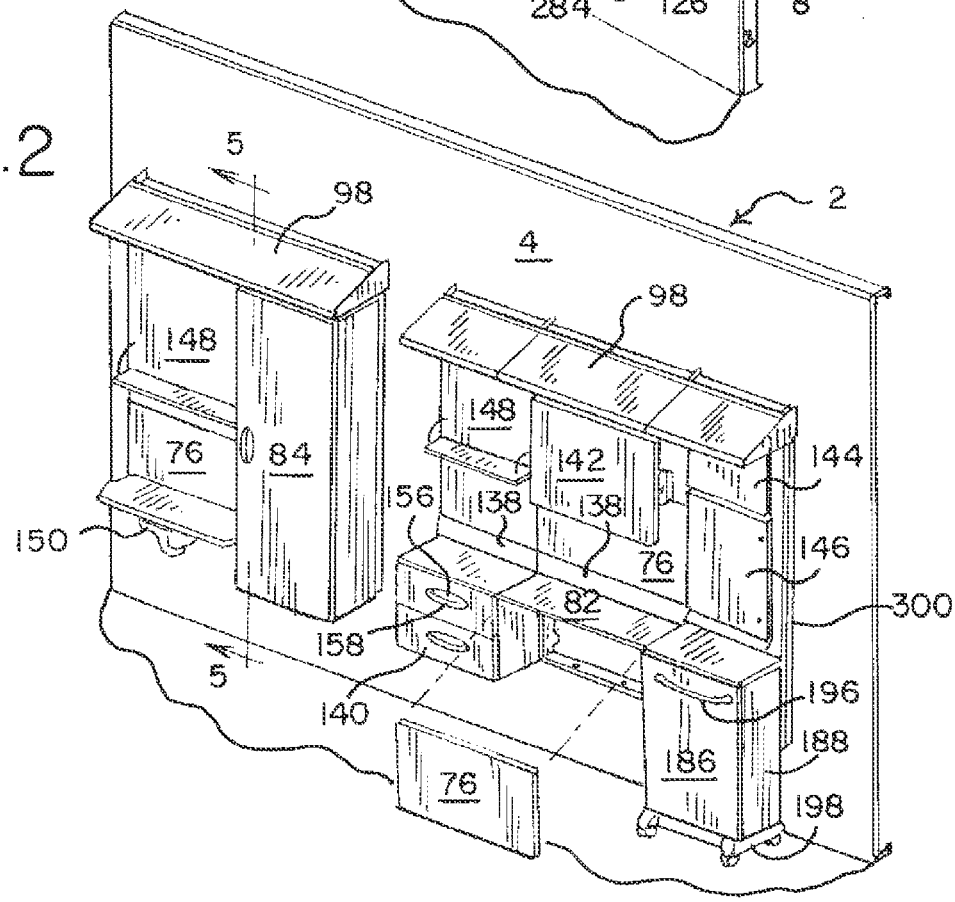
FIG. 2 is a perspective view of another embodiment of wall assembly for a healthcare facility.
Figure 3:
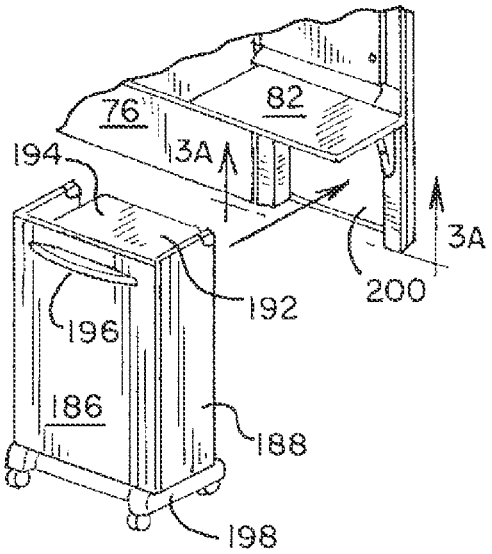
FIG. 3 is a perspective view of the linen cart shown in FIG. 2 moved to a loading position relative to the wall assembly.
Figure 3A:
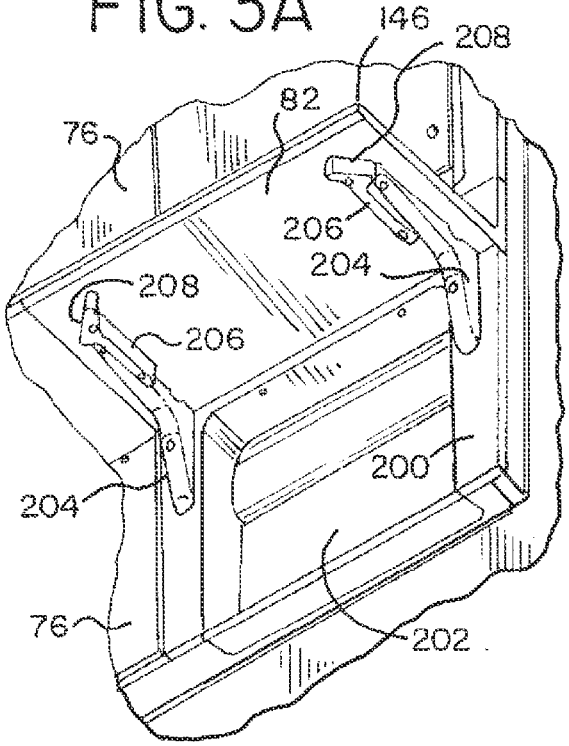
FIG. 3A is a bottom perspective view of the reception area for the linen cart shown along line 3A-3A of FIG. 3.
Figure 4:
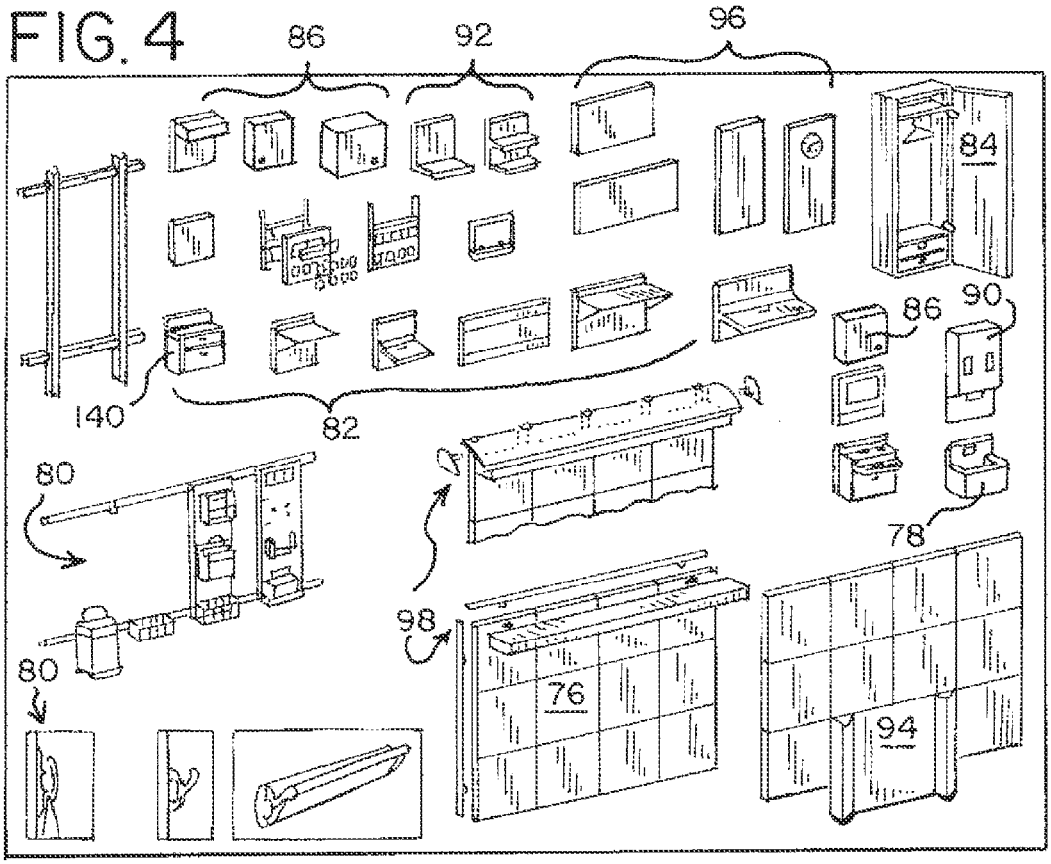
FIG. 4 is a perspective view of various modular wall assembly components.
Figure 5:
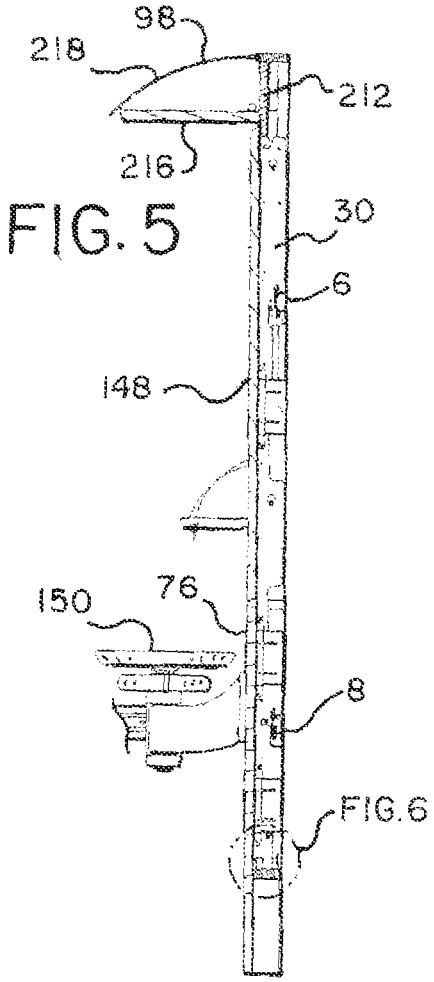
FIG. 5 is a cross-sectional view of one embodiment of a wall assembly taken along lines 5-5 of FIG. 2.

Referring to FIGS. 1 and 2, various wall assemblies are shown mounted to a structural wall 2, defined as any architectural wall, whether permanent or temporary, such as in a hospital or clinic, or configured in a portable environment such as a mobile vehicle. In one embodiment, the wall is configured with interior studs or frame members and a substrate, such as drywall or wall board, applied thereto. The wall has an outer surface 4, which is typically finished with paint, wall paper or other covering.

Rails:

As shown in FIGS. 1, 2 4, 5, 8 and 9, a pair of rails 6, 8 are secured to the wall, for example with anchors or fasteners engaging the interior frame of the wall 2. A backer, such as sheet metal, may be provided on the opposite side of the substrate for engagement by the fasteners. In one embodiment, a pair of vertically spaced and horizontally extending rails 6, 8 are provided, although it should be understood that a single rail or more than two rails may be used. In one embodiment, the upper rail 6 is positioned about 69 inches above the surface of the floor, while the lower rail 8 is positioned about 33⅛ inches above the floor. It should be understood that other heights, and corresponding spacing between the rails may also be suitable.

Referring to FIGS. 12 and 12A, each rail 6, 8 has a rear surface 10 that engages the outer surface 4 of the wall. The rails each define longitudinally extending upper and lower channels 12, 14 defined by upper and lower pairs of flanges 16, 18. The rail further defines an interior channel 20 extending along a length thereof. The channel is sized and configured to provide a raceway for various utilities, such as data and electrical lines or cables 24. A front of the rail includes a cover 22 that closes the channel 20 and hides any cables disposed therein. The cover 22 is made of a low durometer material, and provides an elastic bumper along portions of the rails that may be exposed on opposite sides of any interface components. The rails can be made of various lengths, including for example and without limitation, 24, 36 or 48 inches. Rails also may be formed and/or cut to various custom made lengths. In addition, separate rail modules can be mounted end-to-end to form an elongated rail.

Stiles:

Referring to FIGS. 1, 2, 5-12 and 18-21, a plurality of stiles 30 are coupled to the rails 6, 8. The stiles are disposed forwardly of the rear surface 10 of the rails and the outer surface 4 of the structural wall. The stiles 30 are formed in one embodiment as an elongated channel, for example U-shaped, having a pair of side walls 32 and an outer mounting wall 34, with an interior longitudinally extending channel 36. Preferably, the wall-side of the stiles is open, although it should be understood that a rear wall could also be incorporated, for example by making the stile a tube having a rectangular cross-section. Other shapes may also be suitable.

In one embodiment, the side walls 32 have openings 36 formed therein at vertically spaced apart locations aligned with the rails. The openings form a mouth sized to receive the rail. An upper lip or tab 38 defines a channel shaped to receive the upper, outer flange 16 of the rail 6, 8, with the tab correspondingly received in the upper channel 12 of the rail such that the stile cannot be moved laterally relative to the rail. Once the stile 30 is disposed on the rail(s) 6, 8, an anti-dislodgement clip 38 is secured to the stile with fasteners 40, including for example mechanical fasteners, tabs, clips, and the like. The clip includes an upper lip or tab 42 that overlaps with the outer, lower flange 16 of the rail and is disposed in the lower channel 14 to further secure the stile to the rail 6, 8.

Figure 10:
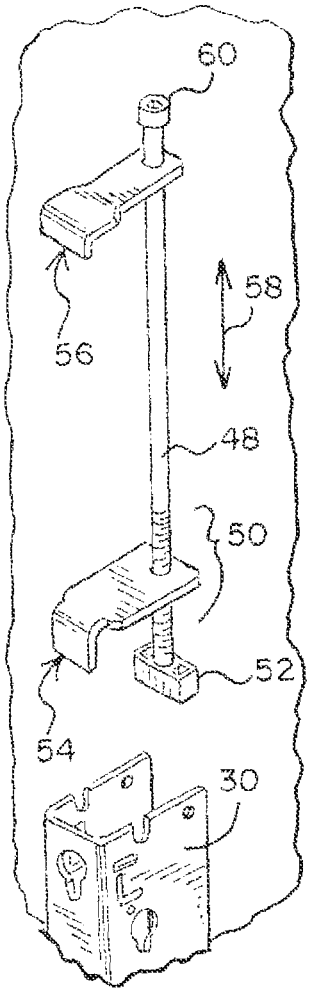
FIG. 10 is an exploded view of a vertical adjustment device.
Figure 11:
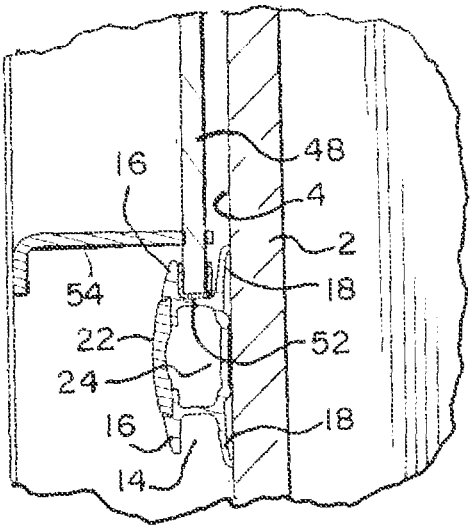
FIG. 11 is a partial cross-sectional view of a vertical adjustment device engaging a rail.

Referring to FIGS. 10 and 11, a connector 46 further secures and supports the stile on the rail. The connector is configured as a vertical adjustment device, and includes a rotatable shaft 48 having a threaded portion 50. A bottom of the connector, which may include a shoe 52, engages the upper channel 12 of one of the rails 6, 8, and preferably the upper rail 6. In one embodiment, the shaft 48 and shoe 52 are rotatable relative to each other. The connector is adjustably coupled to the stile. In one embodiment, the threaded portion 50 threadably engages a support 54 coupled to the stile, for example by welding the support in the channel, or by securing it with tabs, fasteners, or other similar devices or combinations thereof. The shaft is rotatable in first and second directions 58 between different positions, including at least first and second positions. As the shaft 48 is rotated, the threaded portion 50 threadably engages the support 54 and moves the support and connected stile 30 up or down (along direction 58) to various vertical stile positions, including at least a first and second stile position corresponding to the first and second connector position. It should be understood that the connector is infinitely adjustable relative to the support and stile, and that the stile is correspondingly infinitely, vertically adjustable relative to the rail.

In one embodiment, the shaft 48 may be elongated such that a head 60 thereof, which is configured to be engaged by a tool such as a screwdriver or wrench, is presented close to the upper end of the stile. The head may also be enlarged and include a grippable surface, such as knurling. If the shaft is elongated, one or more guides 56 may be coupled to the stile, for example by disposing the guide in the channel and securing it with welding, fasteners and the like. The shaft 48 is rotatable and vertically moveable relative to the guide 56. The guide may be threaded or not. Preferably, the entire vertical load of the stile 30 is transferred to the upper rail 6 by way of the connector. It should be understood that in some embodiments, the stile engages and rests on top of the outer upper flange of the rail.

Figure 6:
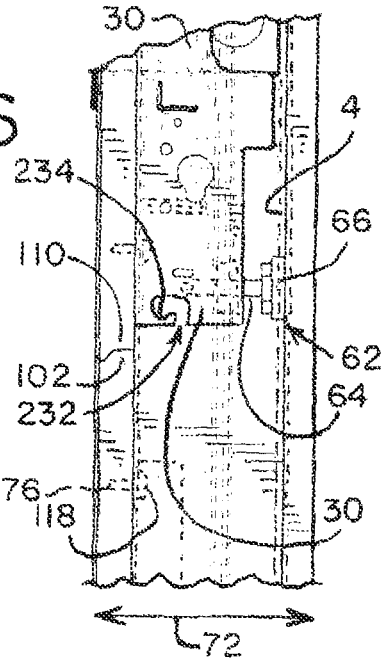
FIG. 6 is an enlarged partial view taken along line 6 of FIG. 5.
Figure 7:
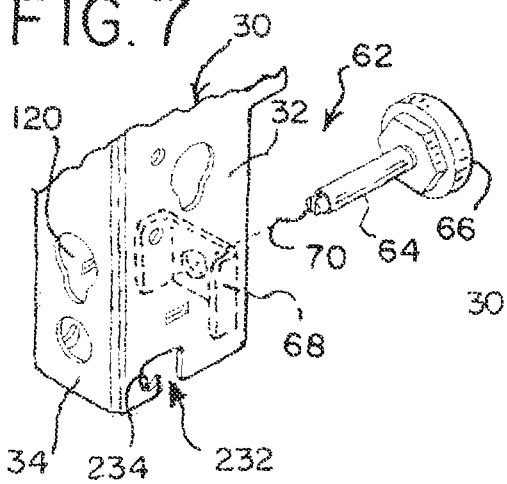
FIG. 7 is an enlarged perspective view of a lateral adjustment member.
Figure 8:
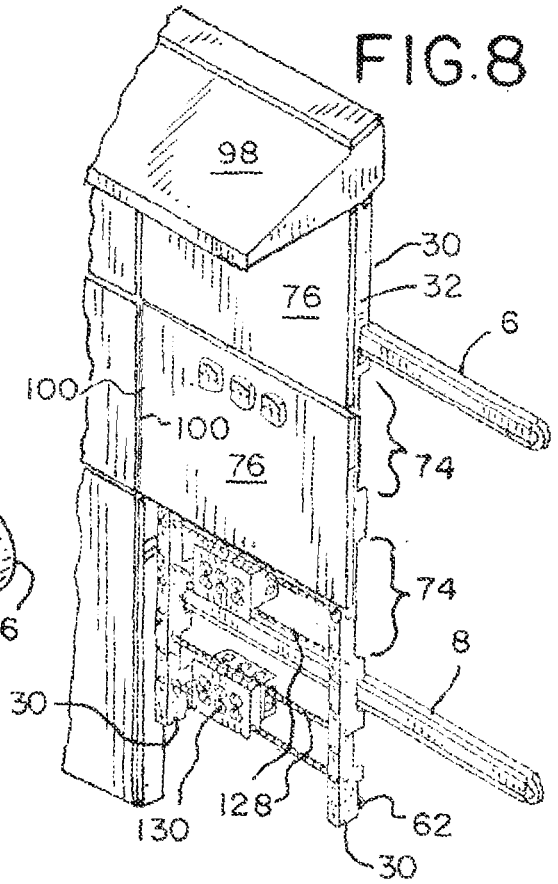
FIG. 8 is a partial perspective view of one embodiment of a wall assembly shown in FIG. 1 with a lower tile removed.

Referring to FIGS. 6-8, a lateral adjustment device 62 is adjustably coupled to each stile 30. The device is preferably vertically spaced below the lower rail 8. It should be understood that the device could be positioned in other locations relative to one or both of the rails. The device is horizontally moveable relative to the stile in a lateral direction 72 toward and away from the wall 2. In one embodiment, the device includes a shaft 64 having a threaded portion threadably engaging a support 68 secured to the stile, for example with fasteners or welding. The device includes a head portion 70 configured to be engaged by a tool such as a screwdriver or wrench, and may include an enlarged grippable portion. The device further includes a foot 66, shown as an enlarged pad presenting a relatively large surface area, which is shaped and configured to engage the outer surface 4 of the wall. The device is adjusted such that the foot engages the wall in a preloaded condition, taking up any slack between the stile 30 and rails 6, 8.

Figure 9:
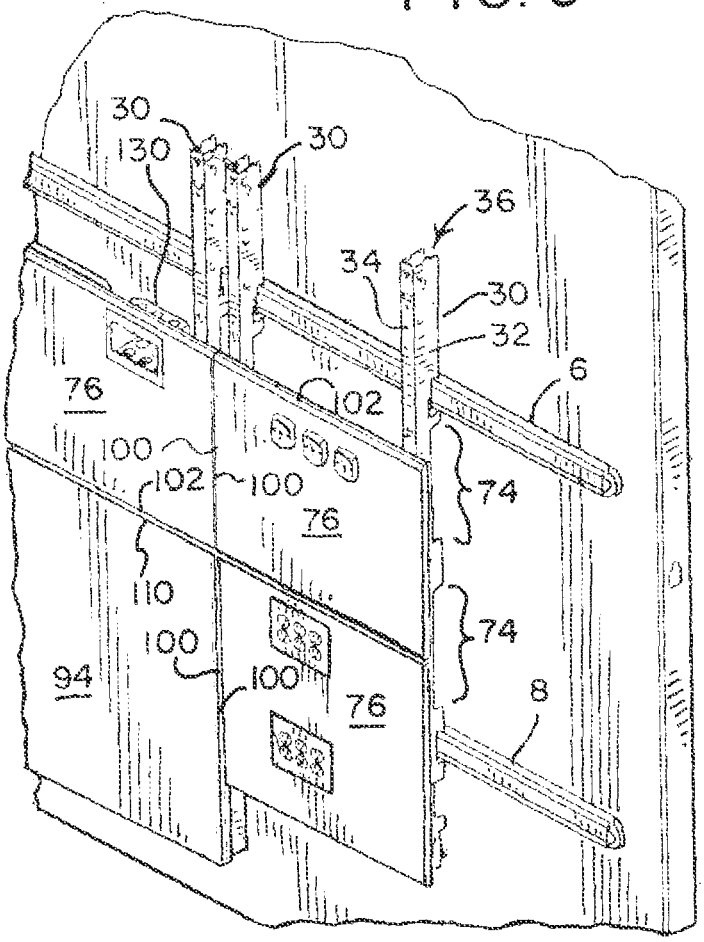
FIG. 9 is a partial perspective view of one embodiment of a wall assembly shown in FIG. 1 with a row of upper tiles and canopy removed.

Referring to FIGS. 8 and 9, portions of the side walls 32 of the stiles positioned between the rails 6, 8 may be cutaway so as to form channels 74 for data, electrical lines and cables, utilities, and other similar systems to be routed along the length of the system through the channels and behind any interface components secured to the stiles 30.

Interface Components:

Various interface components are secured to the stiles, once located on the rails In one embodiment, one interface component may be configured as a glove dispensing device 90 (FIG. 4), which is further disclosed in co-pending U.S. Provisional Application, entitled MEDICAL GLOVE DISPENSING DEVICE AND ASSEMBLY AND METHOD OF DISPENSING MEDICAL GLOVES and having attorney docket number 3591-1779, filed the same day as the present application, the entire disclosure of which is hereby incorporated herein by reference.

As shown in FIGS. 1, 2, 5, 25 and 27, the interface components may include various tiles 76, a wash station 78, tools and accessories 80 (including for example hooks, baskets, etc.), worksurfaces 82, storage units, including for example and without limitation a wardrobe 84, cabinets 86 and drawer units 88, shelving 92, bed docking panels 94, monitors, televisions, white boards, displays 96, canopies 98 etc., and combinations thereof.

For example, and referring to FIGS. 1, 2, 3, 4, 8 and 15-17, one interface component is configured as a tile 76 having opposite side edges 100, upper and lower edges 102, 110 and front and rear surfaces 104, 106. The side edges 100 are chamfered, while the upper and lower edges 110, 102 each have mating surfaces defined by a rear flat portion 112 and a downwardly and forwardly extending portion 114 positioned forwardly of the flat portion. Preferably, no portion of the upper surface of the upper edge 102 is directed downwardly and rearwardly in front of any other portion that may be directed upwardly and rearwardly (or downwardly and forwardly). In one embodiment, the upper edge 102 may have a chamfer formed along a front and/or rear surface. In one embodiment, no chamfers are provided on the rear surface of the tiles. Due to the mating configuration, the lower edge 110 of the upper tile overlaps the upper edge 102 of the lower tile, such that any fluids or contaminants cannot be introduced directly to the interface of the flat portions 112. Moreover, due to the lack of any upwardly/rearwardly extending surface formed on the upper edge 102 rearwardly of the flat portions 112 or rearwardly of a downwardly/rearwardly extending surface (e.g., chamfer), any fluids or contaminants do not tend to flow rearwardly, and cannot be collected or retained by the upper edge 102, but rather are directed outwardly toward the front of the tile. In this way, no portion of the upper edge forms a trough or depression with opposite sides. The lower edge 110 of the tiles also may have a slight chamfer formed along a front and rear surface thereof. It should be understood that other edge configurations would also work, such as a completely angled surfaces 116, extending forwardly and downwardly as shown in FIG. 16A, of course with the understanding that front and rear portions may be chamfered.

The rear surface 106 of the tile is configured with a plurality of buttons 118 that are shaped to be received in the entry passage of a keyhole slot 120, with the tile then being moved downwardly such that a shaft of the buttons is received in a narrow slot of the keyhole with the button engaging the stile. Of course, it should be understood that the tiles can be configured with keyholes and the stiles with buttons, or that the tiles/stiles may be configured with other releasably engaging elements, such as tabs and slots.

In one embodiment, shown in FIG. 16, the tile 76 includes a substrate wrapped with a film 124, e.g., PET. In one embodiment, various objects, such as leaves, symbols, characters, alpha-numeric characters or other 3-D items, are placed on the tile, with the film then being wrapped around the tile so as to create an embossed feature 122, which may provide a pleasing aesthetic appearance. Other interface components, including doors, drawer fronts, and various side walls may also incorporate any embossed feature.

Figure 24:
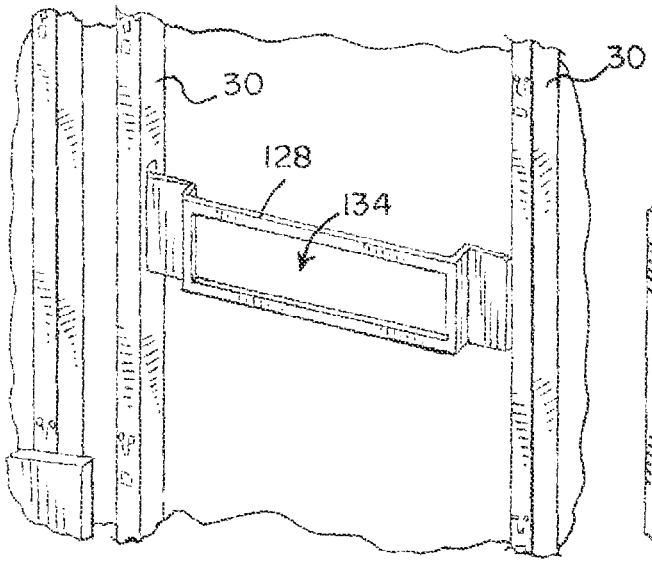
FIG. 24 is a partial view of a pair of stiles with a utility bracket secured thereto.
Figure 25:
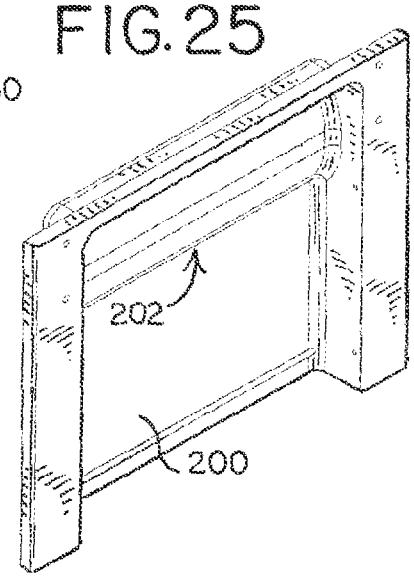
FIG. 25 is a perspective view of a recessed tile.

As shown in FIG. 1, the tiles 76 may be configured with an opening 126 shaped to receive one or more utility outlets, including without limitation a gas, electrical, cable, and/or fluid outlet. Referring to FIGS. 8 and 24, in one embodiment, an interface component 128 configured as a bracket is coupled to a pair of horizontally spaced stiles. The bracket has an opening 134 shaped to receive a plurality of utility outlets 130, including for example gas outlets and electrical receptacles, which are secured to the bracket. Alternatively, the bracket is configured as an upper and lower cross member spaced to receive and secure the outlets. The tile is then disposed over the bracket, with the outlets presented through the opening. A trim or cover 132 may be secured to the tile around the outlets.

Figure 23:
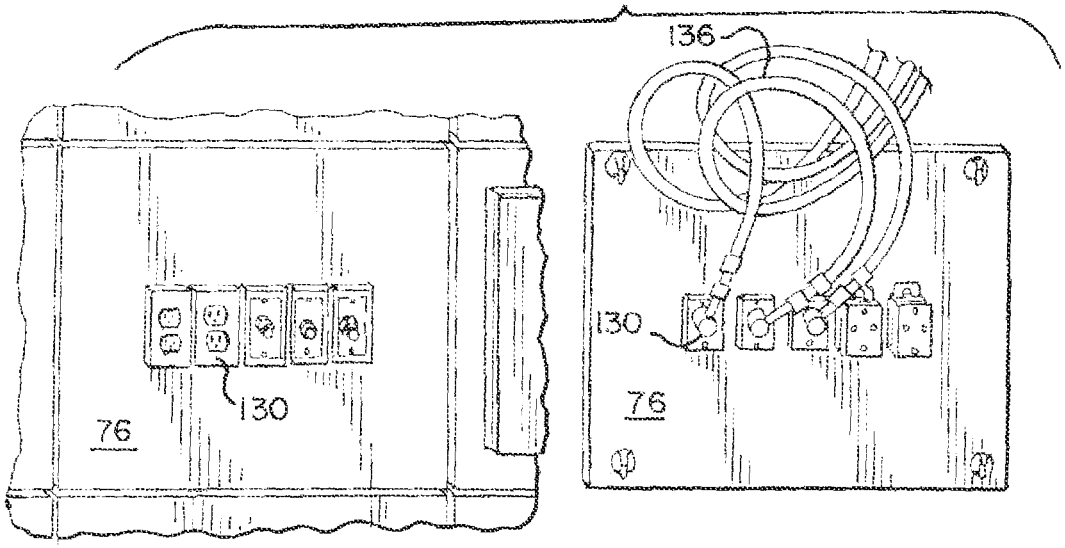
FIG. 23 is a rear view of a tile configured with various utility outlets.

In an alternative embodiment, the outlets 130 are mounted directly to the tiles as shown in FIGS. 1 and 23. A flexible hose 136 connects directly to a gas outlet mounted to the structural wall, for example with a DISS (std) threaded connector. Likewise, electrical connections can be made via a flexible conduit to a junction box mounted to the structural wall.

Other interface components include various worksurfaces 82, which have a rear wall or backsplash 138. The rear wall may be configured with an upper edge 102 as described above to mate with a lower edge of a next upper interface component. Likewise, the worksurface may be configured with a lower edge 110 as described above to mate with an upper edge of a next lower interface component.

Another interface component is a drawer module 140, which also is configured with a worksurface and a backsplash 138 having an upper edge 102, and also a lower edge. Other interface components include a wardrobe 84 and cabinet modules 86, may be configured as necessary with upper and lower edges as described above. As shown in FIG. 2, a monitor, television or other screen 142 can be mounted to a tile, or integrated into a tile and connected to a plurality of stiles. Other interface components include a white board 144, towel dispenser 146 and shelving modules 148. An articulated worksurface 150, with a worksurface supported by and moveable relative to the wall system by way of a linkage mechanism or arm, is also provided. As shown in FIG. 1, a bed docking panel 94 or tile may extend slightly lower than the other tiles in order to interface with a bed frame abutting the tile. With the exception of the bed docking tile, the bottommost surface 152 of the wall assembly is maintained at least 20 inches above the surface of the floor 154 so as to provide access to outlets mounted to the structural wall. In addition, the space provides for movement of various legs on mobile devices, such as stands, beds, overbed tables, and the like beneath the surface.

Figure 29:
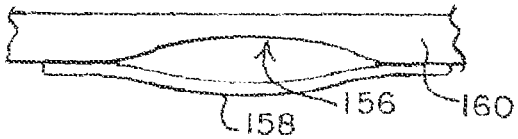
FIG. 29 is an enlarged cross-sectional view of a drawer/door pull and panel.

In one embodiment, and referring to FIG. 29, the drawer and door panels 160 of the interface component modules are provided with a recess 156 and a drawer/door pull 158 disposed over the recess. The pulls are preferably made of a flexible, compliant material, including elastomeric materials such as HYTREL, such that the pulls flex inwardly upon impact, but return to their original shape and configuration thereafter. The recess provides additional finger clearance while minimizing the overall protrusion of the pull. In this way, the pull, in combination with the recess, minimizes impact damage to and from beds, carts, tables and other equipment.

Figure 27:
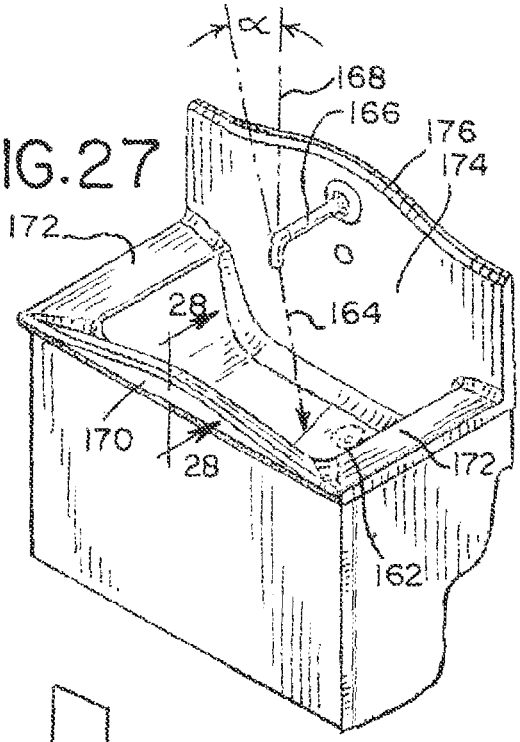
FIG. 27 is a perspective view of a wash station interface component.
Figure 26:
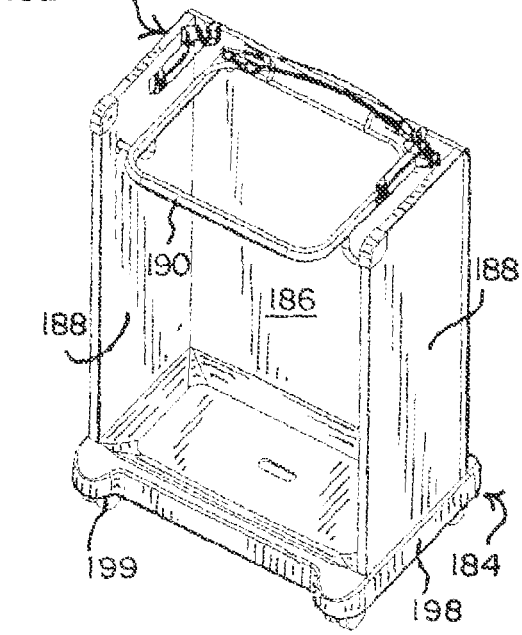
FIG. 26 is a rear perspective view of a linen cart.
Figure 28:
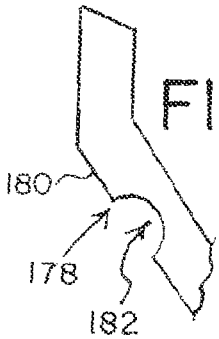
FIG. 28 is an enlarged cross-sectional view of a drip edge taken along line 28-28 of FIG. 27.

Referring to FIG. 27, a wash station interface component 160 is shown. The wash station has a drain hole 162 that is horiztonally offset from the vector 164 defined by the downspout 166, regardless of the position of the faucet. In this way, water coming out of the faucet is prevented from being directed at the drain hole, which can cause unsanitary splash back of materials and bacteria accumulated in the drain hole. In one embodiment, the vector 166 is angled rearwardly toward the rear wall of the wash station and away from the user, forming an angle $\alpha$ relative to a vertical plane 168. As such, any spray against the bottom of the sink is directed away from the user.

The bowl of the wash station provides additional hygienic features. For example, a front splash guard 170, shown as a raised portion of the front of the sink, guards against splashing, particularly, along a path aligned with the faucet. The rim 172 of the sink is angled or tilted inwardly toward the bowl around the front and two sides. In this way, any liquids will run off the rim into the bowl, rather than being accumulated on the rim, or running to the floor. The rear wall 174 of the bowl is integral and monolithic with a vertical splash guard, which avoids accumulation along a difficult to access rear rim, thereby facilitating cleanability. A drip edge 178 is formed by a groove 182 around an exterior periphery of the wash station below the rim. Preferably, the exterior wall 180 is formed at an angle relative to a vertical plane, such that the top, drip edge 178 of the groove is not aligned with the bottom edge of the groove. In one embodiment, the groove 182 is formed as a semi-circular shape, although it should be understood that other shapes would be suitable. The upper edge 176 of the backsplash is configured as described above so as to mate with and be overlapped by a bottom edge of a next upper interface component.

Referring to FIGS. 2, 3, 3A and 26, another interface component is shown as a cart 184. In one embodiment, the cart is configured as a linen cart having a front wall 186, two side walls 188 and an open back. One or more rings 190 can be mounted adjacent an open top 192 of the cart, and are shaped and adapted to support a linen bag 194, which can be used to receive dirty linens. The cart has a bottom supported by a plurality (shown as four) casters 199. A pull 196 and recess, as described above, are positioned along a top portion of the front wall. The base 198 of the cart extends beyond the three walls and acts as a bumper. The cart is sized to fit under a worksurface 82, which, in one embodiment, has a maximum depth of 15.6 inches from the surface 4 of the wall. To accommodate this relatively shallow depth, a tile 200 located behind the cart is configured with a recess 202 shaped to receive the cart. A pair of brackets 204 may be secured to the tile and support the worksurface. In addition, a pair of guides 206, each having an angled or ramped surface 208, are secured to the brackets or worksurface and interface with the inner surface of the side walls 188, guiding the cart and aligning it with the recess as it is parked beneath the worksurface. The cart, when parked, provides a pleasing aesthetic, and appears as if it is integrally connected to the wall assembly.

It should be understood that the various interface components are coupled to the stiles, preferably a pair of horizontally spaced stiles, with a button/keyhole interface, or with fasteners such as screws, bolts, rotatable tabs, hanger tabs, etc. For example, the various non-tile interface components including for example and without limitation the wash station, storage and/or worksurfaces may be secured to the stiles with bolts.

Figure 22:
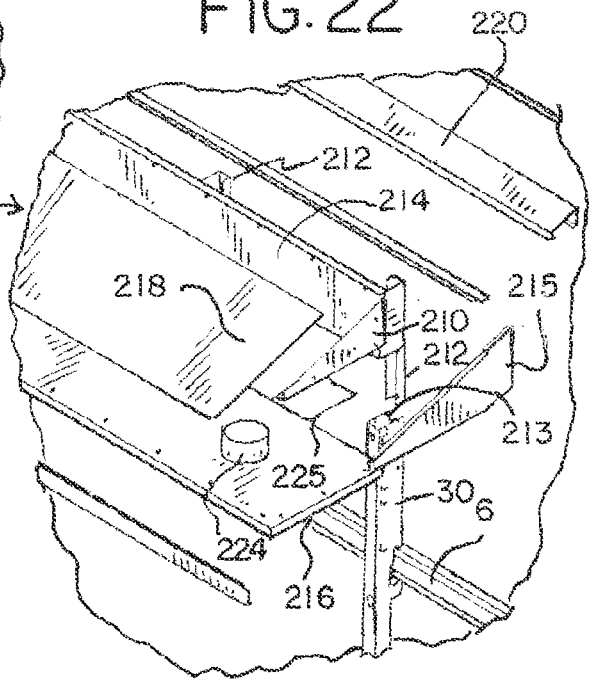
FIG. 22 is an exploded view of a canopy assembly.

Canopy:

Referring to FIGS. 1, 2 and 22, a canopy assembly 98 includes a cross member 214 coupled to a pair of side brackets 210 and a plurality of insert portions 212 or bayonets. The insert portions 212 are shaped to be received in an open, upper end 213 of correspondingly positioned stiles 30. The canopy further includes a bottom soffit 216 and an upper filler 218, preferably translucent, secured to the brackets, with the filler 218 angled downwardly toward the soffit 216, with the soffit and filler meeting at a front leading edge. The filler, or top cover, may be flat or curved. A cover 220 is secured along a rear edge of the canopy and closes off the space against the surface 4 of the wall. A pair of end caps 215, or covers, are secured to the brackets and also seal against the structural wall surface 4. Up or down lighting 225, 224 may be disposed in the interior space defined by the canopy, with the filler functioning as a diffuse light lens for mood up-lighting, and the soffit supporting downwardly directed task lighting 224. In this way, a canopy is supported entirely by the wall system and the stiles in particular rather than the by the structural wall, while abutting and sealing against the wall. In one embodiment, an LED edge lighted panel 225 may be disposed in the canopy.

Assembly:

During assembly, as noted above, at least one, and preferably two, rails 6, 8 are securely fixed to the structural wall 2. A plurality of stiles 30 are then connected to the rails, with the stiles being positioned to receive the modular interface components according to a predetermined layout or plan. For example, as shown in FIG. 1, three pairs of stiles 30 are connected to a pair of rails 6, 8, with three interface tiles 76 (the upper row is exploded for purposes of illustration) connected to each pair of stiles 30. Depending on the type of installation, various outlets may be secured between the stiles with the bracket 128, or connected directly to the tiles, as explained herein above. The stiles 30 are hooked on both rails 6, 8, with upper and lower dislodgment brackets 38 then secured to the stiles 30. Various lines, cables and the like can be routed from outlets in the structural wall between stiles 30, between the stiles and the wall 2 (e.g., through recess 74) and through/along the cavity 24 formed by the rail to a desired location (with a cover 22 being applied over the front of the rail, preferably before mounting the stiles). The stiles 30 may be easily moved horizontally and longitudinally along the length of the rail to a desired position.

The connector 46 is rotated until the shoe 52 or foot engages the upper rail 6 (or lower if desired) and carries the load of the stile 30, and ultimately the weight of any interface components coupled to the stile. The connector shaft 48 can be rotated as needed to level the stiles 30 relative to the rails 6, 8 and/or each other, both prior to and after the interface components are secured to the stiles. The lateral adjustment device 62 on each stile is then rotated to engage the surface 4 of the wall, and is preloaded to prevent rattling or looseness. The preload forces move the tab portions 38 on the lower stile interface to engage or contact the flanges 16 or ribs of the lower rail 8. In this way, the horizontal, lateral position (in-out) of the stile 30 may be adjusted a slight amount.

The various interface modules are then coupled to the stiles in accordance with the predetermined layout, beginning with the lowermost interface components and working your way up, such that a next upper interface element can be seated in the keyholes 120 and moved downwardly into an overlapping configuration with a next lower interface component. The interface components may be secured with the buttons, or other fasteners.

Referring to FIGS. 17-20, a connector member 230, which extends between adjacent stiles supporting adjacent side-by-side interface components, is coupled to the horizontally spaced stiles. The connectors may be slipped through slots 232 formed in the bottom or top ends of the stiles and be carried by a support surface 234 on the bottom end until clamped. In one embodiment, the connector 230 may be configured as a draw member, or draw bolt, that is operable between an unclamped configuration and a clamped configuration. The connector 230 draws the adjacent side edges 100 of the interface components together when moved to the clamped configuration, as shown for example in FIG. 17. For example, in one embodiment, the connector is configured as a bolt, which is rotated to a clamped configuration by pulling the adjacent stiles toward each other to reduce/eliminate any gaps between adjacent interface elements. This elimination of gaps decreases the risk of fluid and bacterial penetration into and between the adjacent interface components.

Figure 20:
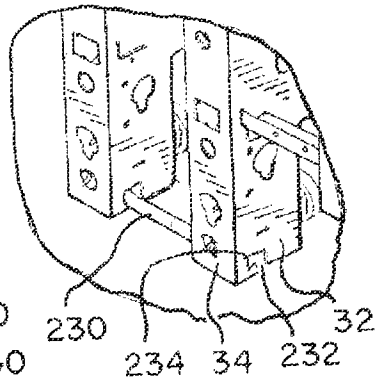
FIG. 20 is a partial view of lower portions of a pair of stiles connected with a draw member.
Figure 19:
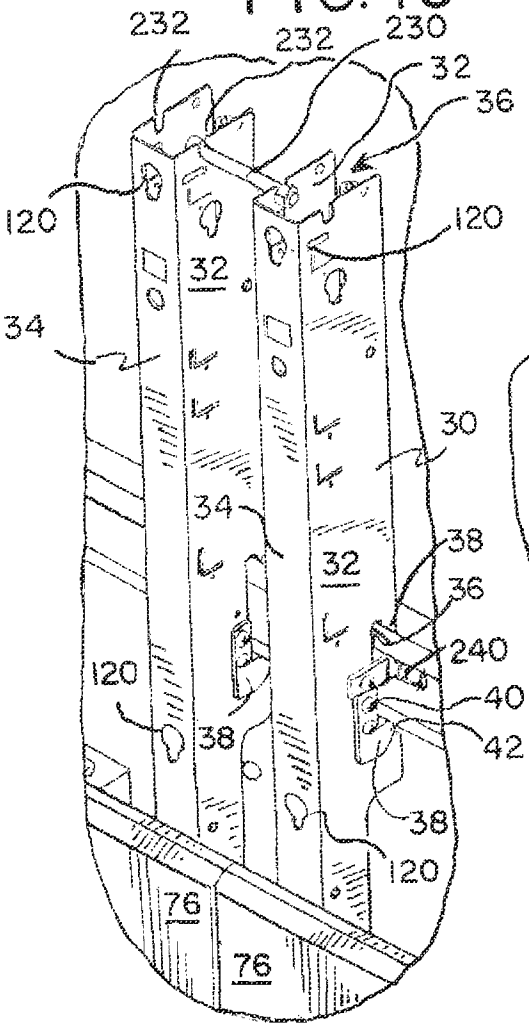
FIG. 19 is a partial view of upper portions of a pair of stiles connected with a draw member.
Figure 18:
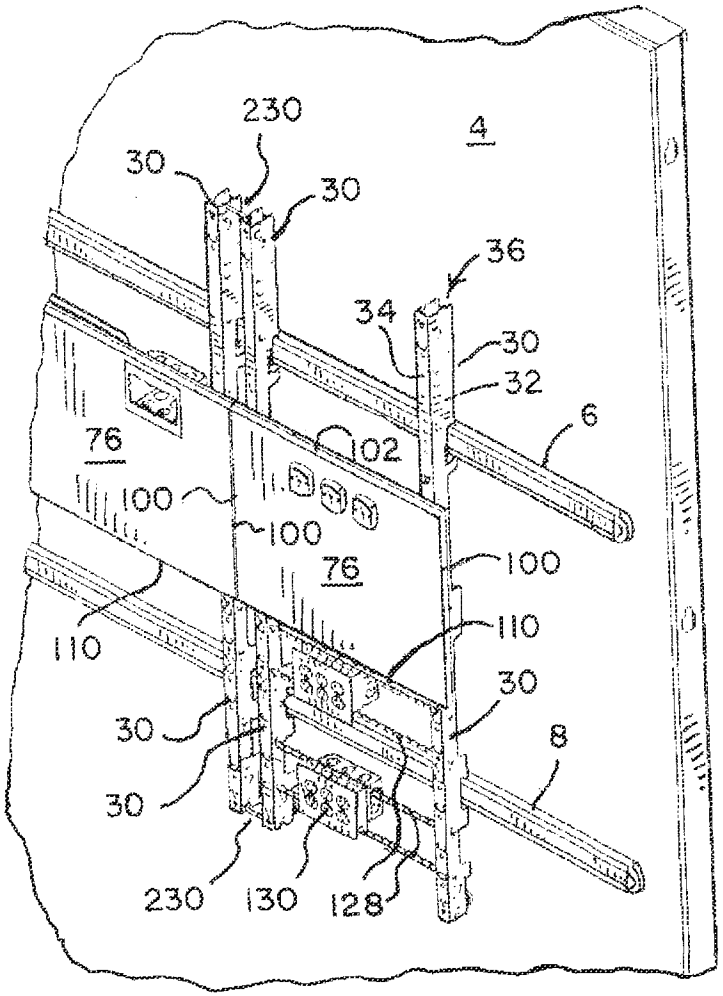
FIG. 18 is a partial view of a wall assembly with various upper and lower tiles removed.
Figure 21:
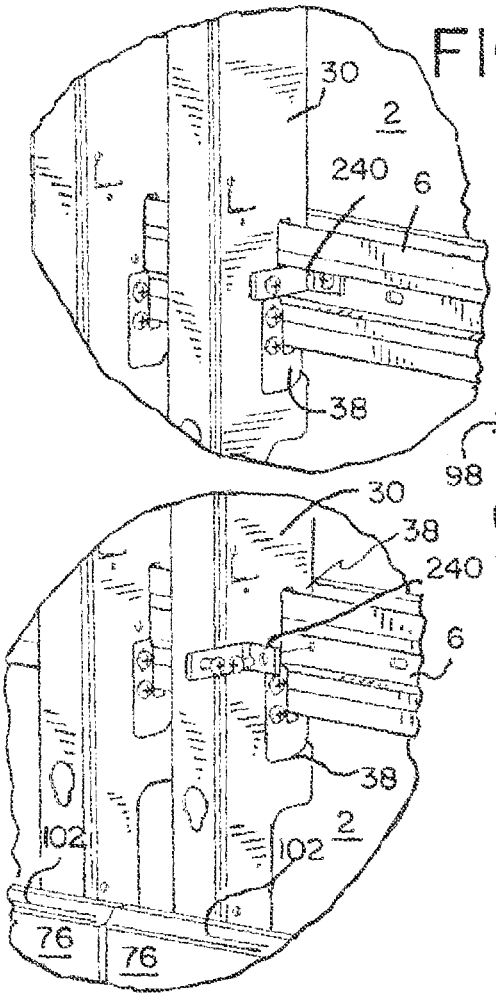
FIG. 21 is a partial view of a lock member connected between a stile and a rail.

Preferably, upper and lower connector members 230 are coupled between adjacent pairs of stiles supporting adjacent interface components as shown in FIGS. 18-20. It should be understood that a connector member could extend between and draw together stiles supporting interface components that are not directly adjacent, but rather are separated by one or more intermediate interface components. For example, a connector member could extend between and connect either of a pair of stiles supporting the outermost interface components, with the middle column of interface components then being sandwiched therebetween.

After the connectors members are installed, all of the plurality of interface components defining a particular wall assembly are interconnected. The entire module is thereafter locked or secured to prevent horizontal movement along the length of the rail. Since the plurality of components are interconnected, only a single stile need be secured or locked. In one embodiment, shown in FIG. 21, a lock member 240 is coupled to a stile and to a rail, thereby immobilizing the stile and the entire module. Alternatively, one of the stiles may be coupled directly to the wall. Alternatively or in combination, an interface component may be secured to the rail or wall.

After or before all of the components are secure, the canopy 98 may be installed along the top of the system, with the bayonet or insert portion 212 inserted into the opening 213 formed in the top of the horizontally spaced stiles. In addition, various side covers 215 are secured along the side of the module between the interface components and the structural wall.

Typically, a wall system includes a plurality of columns 280, 282, 284 of interface components (shown as two or three in FIGS. 1 and 2) situated side-by-side. In some embodiments, an entire column may be occupied by a single interface component, as shown for example by the wardrobe interface component 84 of FIG. 2. In other embodiments, each column is configured with a plurality of interface components (for example three rows 286, 288, 290), with adjacent upper and lower components having overlapping and mating edges 102, 110.

In one embodiment, the horizontally spaced outermost stiles 294, 296 of any particular assembly define a space or footprint therebetween, as shown in FIG. 1. Preferably, the entirety of the space or footprint, including an entirety of the front surfaces of the plurality of stiles, is covered by the plurality of interface components, with all side, upper and bottom edges of the interface components that are disposed adjacent other side, upper and bottom edges of other interface components being in contact with each other, and more specifically with the adjacent side edges being clamped together, such that no gaps are presented over the entirety of the façade, and with the adjacent upper and lower edges overlapping. The top and outermost sides of the system, as well as the bottom if desired, can then be closed off with covers 300 that mate with the wall as shown in FIGS. 12 and 12A. In this way, the wall assembly provides a monolithic façade, which minimizes the risk of various contaminants from infiltrating the system while improving and facilitating the overall cleanability of the system.

It should be understood that the length of the rails 6, 8 can be configured such that the rails are completely covered by the interface components as shown in FIG. 2, or the length can be configured such that they extend beyond the covers and interface components as shown in FIG. 1, such that they are accessible for hanging various tools and accessories thereon.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A wall assembly comprising:

a horizontally extending rail having a rear surface adapted to engage the wall;

a vertically extending stile coupled to said rail;

a canopy coupled to said stile and cantilevered laterally outwardly from said stile; and an interface component coupled to said stile below said canopy, wherein said stile comprises an opening formed in a top end thereof, and wherein said canopy comprises an insert member received in said opening.

2. The wall assembly of claim 1 wherein said canopy comprises a light.

3. The wall assembly of claim 2 wherein said light is an up light.

4. The wall assembly of claim 2 wherein said light is a down light.

5. The wall assembly of claim 2 wherein said light is a LED edge lighted panel.

6. The wall assembly of claim 2 wherein said filler includes a lens to diffuse light.

7. The wall assembly of claim 1 wherein said canopy includes a cross member connected to a pair of side brackets.

8. The wall assembly of claim 7 wherein a soffit and a filler extend from said cross member.

9. The wall assembly of claim 8, wherein said filler extends from said cross member at an angle.

10. The wall assembly of claim 8 wherein said filler is curved.

11. The wall assembly of claim 7 wherein an end cap is connected to one of said side brackets.

12. The wall assembly of claim 1 wherein a cover is connected to said canopy.

13. A wall mounted assembly comprising:

a structural wall comprising an outer surface;

a horizontally extending rail coupled to said structural wall and having a rear surface engaging said outer surface of said wall;

a vertically extending stile coupled to said rail;

a canopy coupled to said stile and cantilevered laterally outwardly from said stile, wherein said canopy comprise a rear surface engaging said outer surface of said wall; and an interface component coupled to said stile below said canopy, wherein said stile comprises an opening formed in a top end thereof, and wherein said canopy comprises an insert member received in said opening.

14. The wall mounted assembly of claim 13 wherein said canopy comprises a light.

15. The wall mounted assembly of claim 14 wherein said light is an up light.

16. The wall mounted assembly of claim 14 wherein said light is a down light.

17. The wall mounted assembly of claim 14 wherein said light is a LED edge lighted panel.

18. The wall mounted assembly of claim 14 wherein said filler includes a lens to diffuse light.

19. The wall mounted assembly of claim 13 wherein said canopy includes a cross member connected to a pair of side brackets.

20. The wall mounted assembly of claim 19 wherein a soffit and a filler extend from said cross member.

21. The wall mounted assembly of claim 20 wherein said filler extends from said cross member at an angle.

22. The wall mounted assembly of claim 20 wherein said filler is curved.

23. The wall mounted assembly of claim 19 wherein an end cap is connected to one of said side brackets.

24. The wall mounted assembly of claim 13 wherein a cover is connected to said canopy adjacent said wall.

25. A wall assembly comprising:

at least one horizontally extending rail having a rear surface adapted to engage a wall;

a plurality of horizontally spaced and vertically extending stiles coupled to said at least one rail;

a plurality of interface components positioned side-by-side, wherein each of said interface components is coupled to at least a pair of said plurality of stiles;

a canopy connected to at least one of said stiles;

at least one connector member extending between and coupled to at least a pair of horizontally spaced stiles supporting different interface components, wherein said plurality of stiles and said plurality of interface components are interconnected; and a lock member configured to be moved from a locked position, wherein said lock member is coupled between one of said stiles and said rail such that said plurality of interconnected stiles and interface components are horizontally fixed relative to said rail and non-moveable along a length thereof, and an unlocked position, wherein said plurality of interconnected stiles and interface components are horizontally moveable relative to and along said rail.

26. The wall assembly of claim 25 wherein said canopy comprises an insert member received in a socket of said at least one stile.

27. The wall assembly of claim 25 wherein said canopy includes a cross member connected to a pair of side brackets.

28. The wall assembly of claim 27 wherein a soffit and a filler extend from said cross member.

29. The wall assembly of claim 28 wherein said filler extends from said cross member at an angle.

30. The wall assembly of claim 28 wherein said filler is curved.

31. The wall assembly of claim 27 wherein an end cap is connected to one of said side brackets.

32. The wall assembly of claim 25 wherein a cover is connected to said canopy.

33. The wall assembly of claim 25 wherein said canopy includes a light.

34. The wall assembly of claim 33 wherein said light is an up light.

35. The wall assembly of claim 33 wherein said light is a down light.

36. A wall assembly comprising:

a horizontally extending rail;

a vertically extending stile;

a connector engaging said rail, wherein said connector is adjustably coupled to said stile, wherein said connector is moveable between at least first and second connector positions, wherein said stile is moveable vertically relative to said rail between first and second stile positions corresponding to said first and second connector positions, wherein said connector comprises a shaft having a threaded portion rotatable between said at least said first and second positions, wherein said threaded portion threadably engages a support coupled to said stile, wherein said shaft moves vertically relative to said support as said shaft is rotated between said at least said first and second positions; and a canopy connected to said stile.

37. The wall assembly of claim 36 wherein said canopy includes a cross member connected to a pair of side brackets.

38. The wall assembly of claim 37 wherein a soffit and a filler extend from said cross member.

39. The wall assembly of claim 36 wherein said canopy includes a light.

40. The wall assembly of claim 39 wherein said light is an up light.

41. The wall assembly of claim 39 wherein said light is a down light.

42. The wall assembly of claim 36 wherein a tile is connected said stile.

43. A wall assembly comprising:

a horizontally extending rail comprising a rear surface adapted to engage a wall;

a vertically extending stile coupled to said rail;

a lateral adjustment device adjustably coupled to said stile, wherein said lateral adjustment device is vertically spaced from said rail, wherein said lateral adjustment device comprises a wall engaging surface and wherein said lateral adjustment device is horizontally moveable relative to said stile from at least a disengaged position to an engaged position, wherein said wall engaging surface is positioned to be spaced from said wall when said lateral adjustment device is in said disengaged position, and wherein said wall engaging surface is positioned to engage the wall when said lateral adjustment device is in said engaged position; and a canopy connected to said stile.

44. The wall assembly of claim 43 wherein said canopy includes a cross member connected to a pair of side brackets.

45. The wall assembly of claim 44 wherein a soffit and a filler extend from said cross member.

46. The wall assembly of claim 43 wherein said canopy includes a light.

47. The wall assembly of claim 46 wherein said light is an up light.

48. The wall assembly of claim 46 wherein said light is a down light.

49. The wall assembly of claim 43 wherein a tile is connected said stile.

* * * * *